United States Patent [19]

Nakai et al.

[11] 4,277,192

[45] Jul. 7, 1981

[54] END OF LINE LOCKING MECHANISM FOR POWER OPERATED TYPEWRITER

[75] Inventors: Toshio Nakai, Nagoya; Susumu Kuzuya, Gifu; Hiroshi Onoda, Kariya; Takayuki Iwase, Chiryu; Akira Asai, Nagoya, all of Japan

[73] Assignee: Brother Industires, Ltd., Nagoya, Japan

[21] Appl. No.: 1,587

[22] Filed: Jan. 8, 1979

[30] Foreign Application Priority Data

Feb. 1, 1978 [JP] Japan ..... 53-10729

[51] Int. Cl.[3] ..... B41J 29/54

[52] U.S. Cl. ..... 400/671; 400/346; 400/161; 400/440.2

[58] Field of Search ..... 400/8, 52, 671, 671.1, 400/671.2, 671.3, 671.4, 672, 672.1, 672.2, 346, 161, 440.2

[56] References Cited

U.S. PATENT DOCUMENTS

| | | | |
|---|---|---|---|
| 3,086,635 | 4/1963 | Palmer | 400/52 |
| 3,195,707 | 7/1965 | Reynard | 400/52 |
| 3,353,646 | 11/1967 | Young | 400/52 |
| 3,382,963 | 5/1968 | Cralle et al. | 400/8 |
| 3,404,766 | 10/1968 | Castle et al. | 400/8 X |
| 3,592,313 | 7/1971 | Castle et al. | 400/52 X |
| 3,827,542 | 8/1974 | Blum | 400/52 |
| 3,871,505 | 3/1975 | Theilen | 400/8 |

OTHER PUBLICATIONS

IBM Technical Disclosure Bulletin, "Line Lock Mechanism", Palmer, vol. 10, No. 12, May 1968, p. 1911.

IBM Technical Disclosure Bulletin, "Space-to-Print and Print-to-Space Interlock", EMIG, vol. 12, No. 3, Aug. 1969, pp. 471–472.

*Primary Examiner*—Ernest T. Wright, Jr.

*Attorney, Agent, or Firm*—George B. Oujevolk

[57] ABSTRACT

A power operated typewriter having an end of line locking mechanism comprises a clutch interposed between a drive motor and a printing mechanism, a control lever for engaging the printing clutch to print a character by the printing mechanism when a key lever is depressed, and lock means for locking the control lever so as to hold the printing clutch in its disengaged condition, which can prevent any printing operation even if the key lever is depressed after the right-hand margin position has been reached and is operative.

9 Claims, 21 Drawing Figures

END OF LINE LOCKING MECHANISM FOR POWER OPERATED TYPEWRITER

BACKGROUND OF THE INVENTION

1. Field of the Invention

This invention relates to an end of line locking mechanism for power operated typewriters which can prevent a printing operation after the right-hand margin position has been reached and becomes operative.

2. Description of the Prior Art

Typewriters include a right-hand margin which is operative with the movement of the carriage caused when each key or the space bar of the keyboard is depressed. There has been a need for a line lock mechanism capable of positively preventing a printing operation after the right-hand margin position has been reached and becomes operative.

A line lock mechanism for typewriters is disclosed in Selectric Instruction Manual published in 1964 by IBM Corporation which includes a lock lever adapted to be held between two of a plurality of balls arranged in a row. However, such a conventional line lock mechanism is expensive, requires higher assembling accuracy, is unsuitable for use in inexpensive typewriters, and is insufficient to fully prevent the printing operation after the right-hand margin position has been reached and becomes operative during high speed typing operation.

OBJECTS OF THE INVENTION

It is an object of the present invention to provide a line lock mechanism for power operated typewriters which can prevent a printing operation after the right-hand margin position has been reached and becomes operative.

Another object of the present invention is to provide a line lock mechanism for electric typewriters which can lock a printing clutch in its disengaged state when the right-hand margin position has been reached so as to prevent a printing operation thereafter.

Still another object of the present invention is to provide a line lock mechanism particularly suitable for use in an inexpensive power operated typewriter which can prevent a printing operation after the right-hand margin position has been reached and becomes operative.

BRIEF DESCRIPTION OF THE DRAWINGS

FIGS. 1 to 5*c* illustrate a first embodiment of a line lock mechanism constructed in accordance with the present invention.

FIG. 1 is a sectional view showing the main portion of a typewriter.

FIG. 2 is a perspective view of the typewriter.

FIG. 3 is an enlarged sectional view showing a clutch mechanism.

FIG. 4 is an enlarged sectional view showing a clutch member, clutch control lever, holding lever, and lock member.

FIGS. 5*a* to 5*c* are sectional views used to explain the operation of the components of FIG. 4.

FIGS. 6 to 7*c* illustrate a second embodiment of the present invention.

FIG. 6 is a sectional view showing the main portion of the second embodiment.

FIGS. 7*a* to 7*c* are sectional views used in explaining the operation of the components of FIG. 6.

FIGS. 8 to 10*c* illustrate a third embodiment of the present invention.

FIG. 8 is a perspective view showing the main portion of the third embodiment.

FIG. 9 is an enlarged sectional view of the main portion of FIG. 8.

FIGS. 10*a* to 10*c* are sectional views used in explaining the operation of the components of FIG. 9.

FIGS. 11 to 13*c* illustrate a fourth embodiment of the present invention.

FIG. 11 is a perspective view showing the main portion of the fourth embodiment.

FIG. 12 is an enlarged sectional view showing the main portion of FIG. 11.

FIGS. 13*a* to 13*c* are sectional views used to explain the operation of the components of FIG. 12.

DESCRIPTION OF THE PREFERRED EMBODIMENTS

Figure 1:
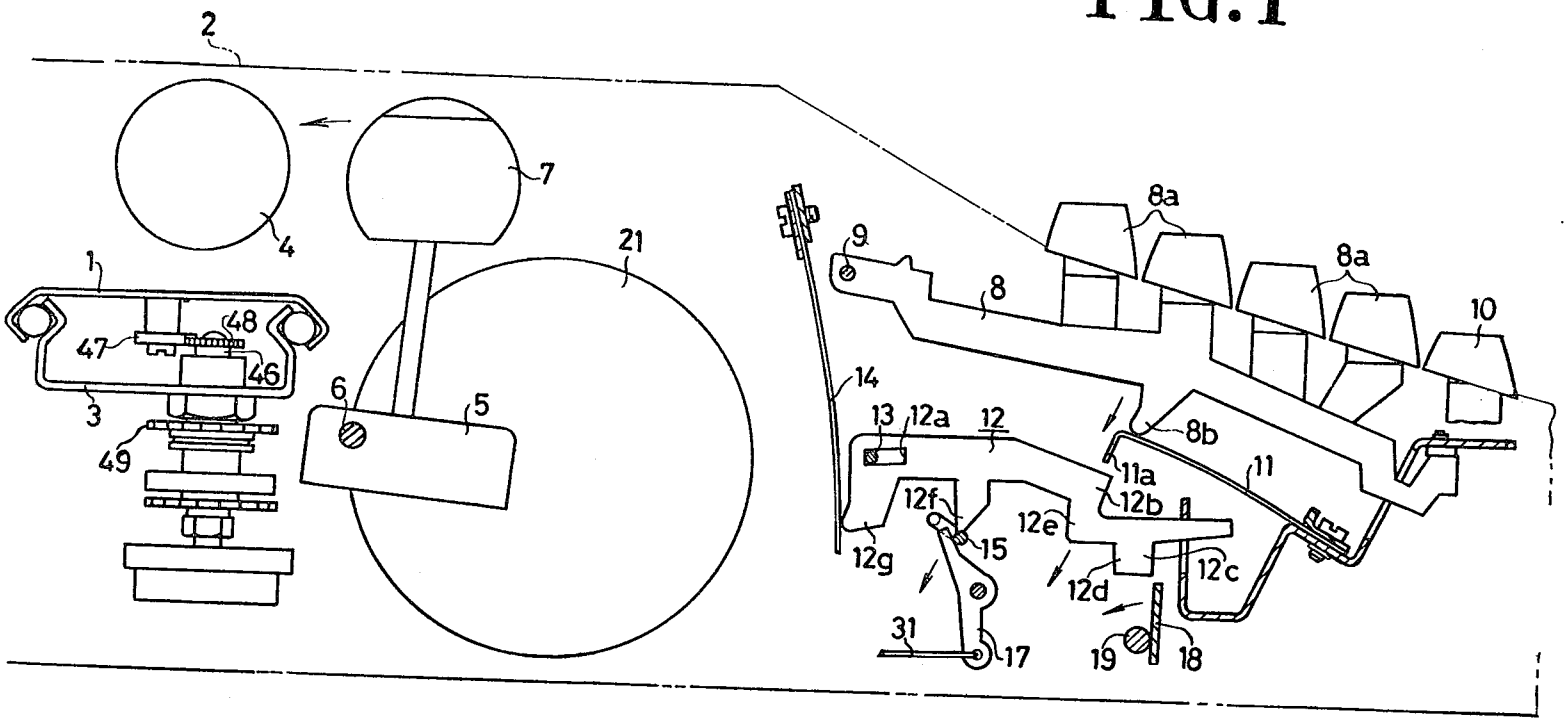

Referring now to FIGS. 1 to 5*c* there is shown a first embodiment of a line lock mechanism constructed in accordance with the present invention. A carriage 1 is mounted for leftward and rightward movement on a base plate 3 provided in the rear portion of a machine frame 2 and carries a platen 4 thereon. A support table 5 is rotatably mounted on a support shaft 6 in front of the carriage 1. A printing head 7 is supported for tilting and rotating motion on the support table 5 and has a number of types arranged on its outer surface in rows and columns.

A number of key levers 8 are rotatably supported on a support shaft 9 transversely extending in the front portion of the machine frame 2, each of which has a key 8*a* on its upper side and a projection 8*b* extending downward from its lower side. A space bar 10 is provided for downward movement (in the right side of the keys 8*a* in FIG. 1). Resilient operation plates 11 are arranged below each projection 8*b* of each corresponding key lever 8 and have their front ends secured to the machine frame 2 and the other ends 11*a* bent downward. Interposers 12 are respectively arranged below each corresponding key lever 8, each of which is formed in its rear end portion with an elongated aperture 12*a* in which a support shaft 13 is loosely inserted to support the interposers 12 such that the interposers 12 can move rotatably and can reciprocate. Each of the interposers 12 has on its upper side a shoulder portion 12*b* facing the bent portion 11*a* of the corresponding operation plate 11. The interposer 12 also has an operating projection 12*c*, tilt selection stepped portions 12*d* and 12*e*, a clutch operating projection 12*f*, and a rotate selection projection 12*g* arranged on its lower side in the front-to-back direction. Each interposer 12 is urged upward and forward to be held in its original position by means of a leaf spring 14 secured to the machine frame 2 and placed in pressure contact with the rotate selection projection 12*g* thereof, and can be rotated downward from the original position through each operation plate 11 when a key lever 8 having thereon a key 8*a* is depressed to push down the corresponding operation plate 11. The operating projections 12*f* of the interposers 12 are in contact with a clutch operating rod 15 which is rotatably mounted at its opposite ends on the machine frame 2 and is spring biased in the counterclockwise direction in FIG. 1 by means of a tension spring 16. A clutch operating lever 17 is rotatably mounted on the machine frame 2 and is engaged at its upper end portion with the clutch operating rod 15 such that it can be rotated in the counterclockwise direction in FIG. 1 by the clutch operating rod 15 when an interposer 12 is pushed down, and the clutch operating lever 17 can be returned to the original position, which will be described later when the interposer 12 is released. A drive plate 18 is rotatably mounted through the rotary shaft 19 on the machine frame 2 in the position facing the operating projections 12*c* of the respective interposers 12, which is rotated a predetermined angle by a clutch mechanism to be described later to rearwardly push the operating projection 12*c* of the interposer 12 downwards when the corresponding key 8*a* is depressed.

The rearward movement of the interposer 12 causes the stepped portions 12*d* and 12*e* to drive the tilt selection mechanism (not shown) so as to tilt the printing head 7 a predetermined angle thereby placing the desired type row into the position facing the printing position on the platen 4 and also the rotate selection projection 12*g* to drive the rotate selection mechanism (not shown) through the leaf spring 14 so as to rotate the printing head 7 by a predetermined angle thereby placing the desired type column into the position facing the printing position on the platen 4, whereby the type corresponding to the letter indicated on the desired key 8*a* can be placed into the position facing the printing position on the platen 4.

Figure 2:
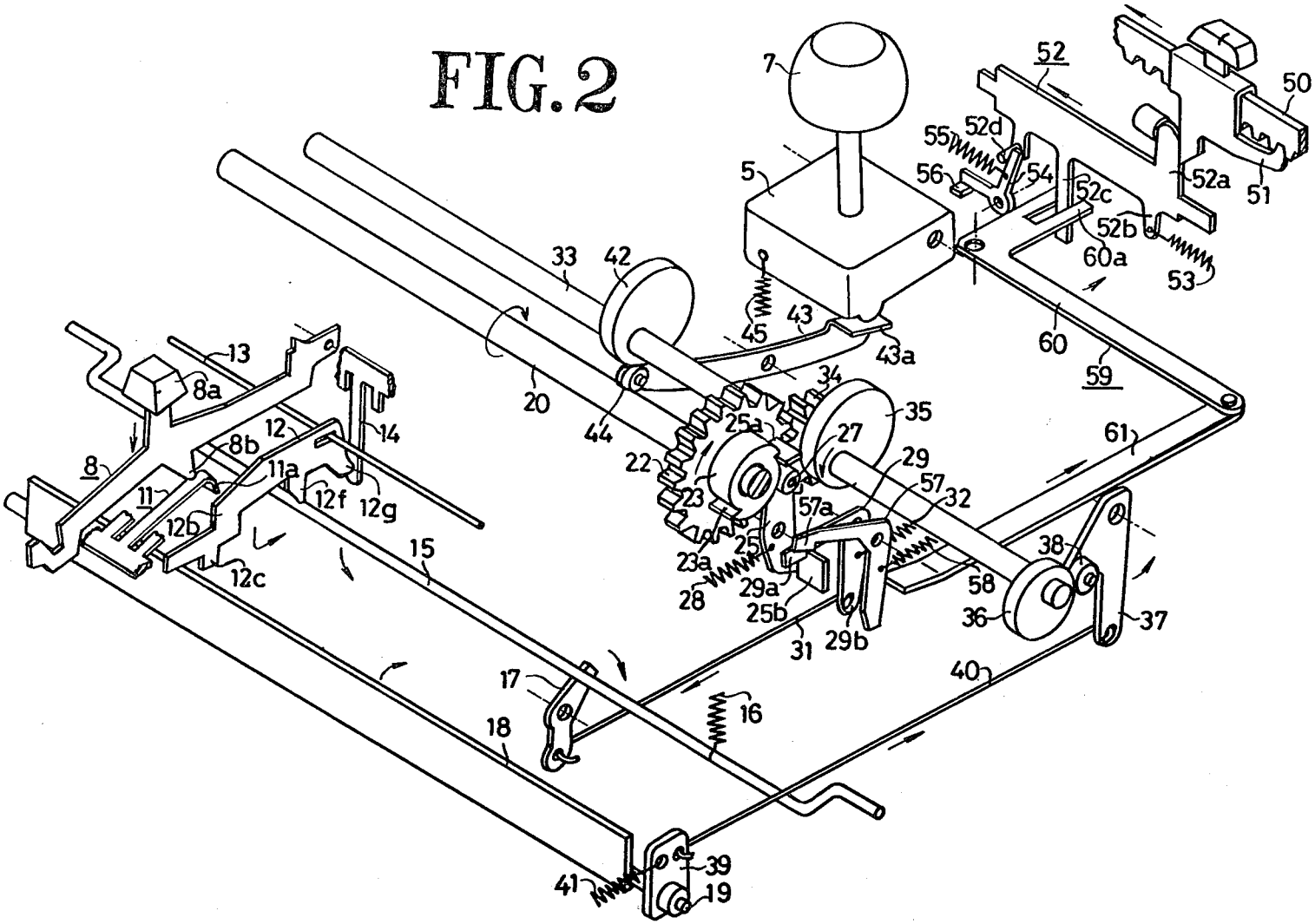
Figure 3:
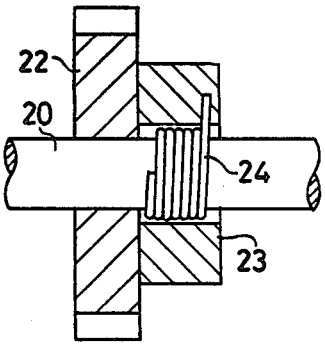

The printing clutch mechanism will be described in greater detail. A drive shaft 20 is rotatably mounted on the machine frame 2. A drive motor 21 is coupled through a suitable coupling mechanism to the drive shaft 20 to rotate it in the direction indicated by the arrow of FIG. 2. A drive gear 22 is rotatably mounted on the drive shaft 20 and has on its one side surface a substantially cylindrical clutch member 23 formed on its outer peripheral surface with two clutch pawls 23*a*. A clutch spring 24 is wound around the drive shaft 20 within the clutch member 23 and fixed at its one end only to the clutch member 23 as best shown in FIG. 3. The clutch spring 24 serves to allow rotation of the drive shaft 20 alone when rotation of the clutch member 23 is restricted, and allow the transmission of rotation of the drive shaft 20 to the clutch member 23 and the drive gear 22 when the clutch member 23 can freely rotate. The printing clutch mechanism is composed of clutch member 23 and the clutch spring 24.

Figure 4:
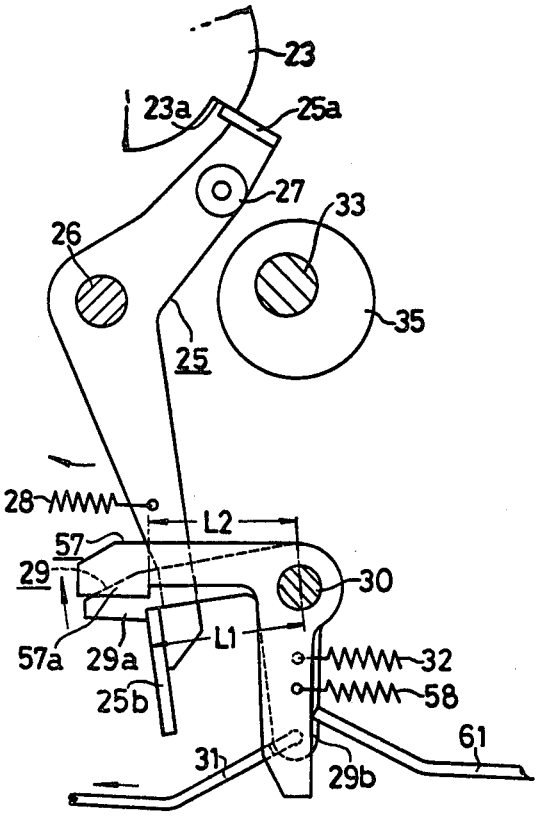

A clutch control lever 25 is rotatably mounted in the vicinity of the clutch member 23 on a support shaft 26 secured to the machine frame 2. The clutch control lever 25 has on its upper end an engagement portion 25*a* engageable with and disengageable from one of the clutch pawls 23*a* of the clutch member 23 and has on its lower end a holding portion 25*b*. A cam follower 27 is mounted on the clutch control lever 25. A tension spring 28 is provided to urge the clutch control lever 25 in such a direction that the engagement portion 25*a* is held out of engagement from the clutch pawls 23*a*. A latch lever 29 is rotatably mounted in the vicinity of the clutch control lever 25 on a support shaft 30 secured on the machine frame 2. The latch lever 29 has on its front end a hook portion 29*a* engageable with and disengageable from the holding portion 25*b* of the clutch control lever 25 and an arm portion 29*b* connected with a coupling rod 31 which extends to the clutch operating lever 17. A tension spring 32 is provided to bias the latch lever 29 in such a direction that the hook portion 29*a* can be held in engagement with the holding portion 25*b* of the clutch control lever 25 thereby normally holding the clutch control lever 25 in a first position where the engagement portion 25*a* of the clutch control lever 25 is in engagement with the clutch pawl 23*a* of the clutch member 23 as shown in FIG. 4 so as to release the clutch spring 24. When a desired key 8*a* is depressed to push the corresponding interposer 12 down thereby rotating the clutch operating lever 17, the coupling rod 31 rotates the latch lever 29 in such a direction that the hook portion 29*a* of the latch lever 29 disengages from the holding portion 25*b* of the clutch control lever 25 thereby allowing the tension spring 28 to rotate the clutch control lever 25 to a second position where the engagement portion 25*a*, of clutch control lever 25 is out of engagement from the clutch pawl 23*a* of the clutch member 23 as shown by the solid line of FIG. 5*a* thereby holding the clutch spring 24 in its engaged condition.

Figure 5A:
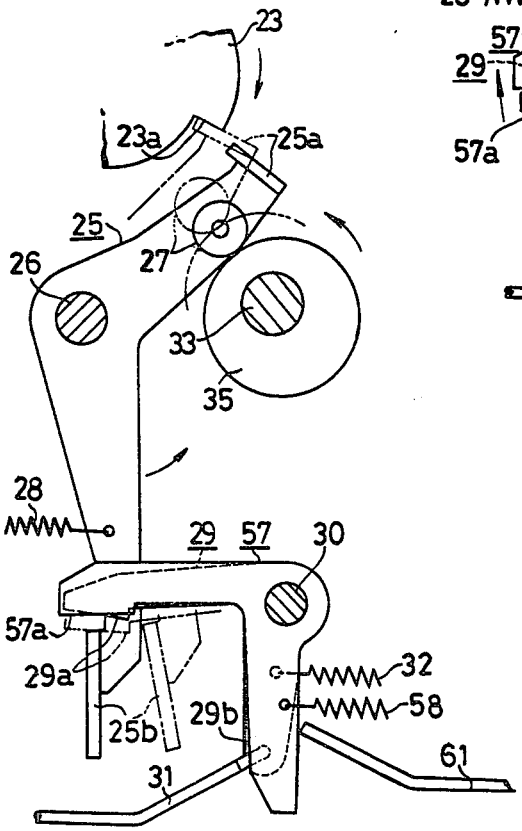

A cam shaft 33 extending in parallel with the drive shaft 20 is rotatably mounted on the machine frame 2. As shown in FIG. 2, the cam shaft 33 has thereon a driven gear 34 in engagement with the drive gear 22 so that rotation of the drive shaft 20 can be transmitted through the drive gear 22 and the driven gear 34 to the cam shaft 33 when a desired key lever 8 is depressed to engage the clutch spring 24. The driven gear 34 and the drive gear 22 are designed so as to rotate together with ratio of 2 by 1. A return cam 35 is secured to the cam shaft 33 adjacent to the driven gear 34. The return cam 35 is moved into engagement with the cam follower 27 with the rotation of the cam shaft 33 to temporarily return the clutch control lever 25 against the force of the tension spring 28 from the second position as shown in FIG. 5*a* to a third position passing over the first position as shown by the dotted line of FIG. 5*a* where the clutch spring 24 can be disengaged. Thus, when the clutch operating lever 17 is rotated to the original position under the described above condition, the hook portion 29*a* of the latch lever 29 is engaged with the holding portion 25*b* of the clutch control lever 25 as shown by the dotted line of FIG. 5*a*, whereby the clutch control lever 25 is held in the first position as shown in FIG. 4. After the clutch member 23 rotates half a turn, its rotation is restricted and the clutch spring 24 is disengaged, whereby the cam shaft 33 stops at the condition of one rotation.

A drive cam 36 is secured to one end of the cam shaft 33 and a lever 37 is rotatably mounted on the machine frame 2 in the vicinity of the drive cam 36. As shown in FIG. 2, the lever 37 has on its arm portion a cam follower 38 rotatably mounted thereon and in engagement with the drive cam 36. A coupling plate 39 is secured to one end of the rotary shaft 19 extending below the interposers 12. A coupling rod 40 connects the coupling plate 39 with the lever 37. A tension spring 41 is interposed between the coupling plate 39 and the machine frame 2 to urge the cam follower 38 into pressure contact with the drive cam 36 through the coupling rod 40 and also to normally hold the drive plate 18 in the upright position as shown in FIG. 1. When a desired key lever 8 is depressed to push the corresponding interposer 12 down thereby rotating the cam shaft 33 fully once, the drive cam 36 rotates the drive plate 18 a predetermined angle through the lever 37, the coupling rod 40, and the coupling plate 39 to push the interposer 12 rearward.

A printing mechanism for operating the printing head 7 when a key lever 8 is depressed will be described. As shown in FIG. 2, an operation cam 42 is secured to the cam shaft 33 and an operation lever 43 is rotatably mounted on the machine frame 2 in the vicinity of the operation cam 42. The operation lever 43 has on its front end a cam follower 44 rotatably mounted thereon and placed in engagement with the operation cam 42. The operation lever 43 also has on its rear end an operation portion 43*a* placed in engagement with the lower side of the support table 5 on which the printing head 7 is supported. A tension spring 45 is interposed between the support table 5 and the machine frame 2 to normally hold the printing head 7 in the original position as shown in FIG. 1. When a key lever 8 is depressed to push the corresponding interposer 12 down thereby rotating the cam shaft 33 fully once, the drive plate 18 rotates to push the interposer 12 rearward thereby driving the tilt selection mechanism and the rotate selection mechanism so as to selectively place a type corresponding to the key lever 8 into the position facing the printing position on the platen 4. Thereafter, the operation cam 42 operates the operation lever 43 so as to rotate the support table 5 and thus the printing head 7 in the direction indicated by the arrow in FIG. 1, whereby the selected type can print a letter on a paper sheet placed on the platen 4.

An escapement mechanism for intermittently moving the carriage 1 a predetermined pitch in the letter feed direction every time the space bar 10 is depressed or in synchronism with a printing operation will be described. As shown in FIG. 1, a rotary shaft 46 is rotatably mounted on the base plate 3, which has on its upper end a pinion 48 arranged in engagement which a rack plate 47 mounted on the lower surface of the carriage 1. A ratchet wheel 49 is mounted centrally on the rotary shaft 46 and biased to rotate in one direction through the rack plate 47 and the pinion 48 by a suitable biasing means (not shown) urging the carriage 1 in the letter feed direction. An escapement mechanism (not shown) of a conventional type having a pair of hook pawls or the like is disposed in the position facing to the ratchet wheel 49. The hook pawls alternatively come into engagement with the ratchet wheel 49 to move the carriage 1 half a pitch in the letter feed direction when a key lever 8 is depressed to drive the printing head 7 or when the space bar 10 is depressed and then the carriage 1 further moves half a pitch in the letter feed direction when the printing head 7 returns to the original position or the space bar 10 returns to the original position so that the carriage 1 moves one pitch in the letter feed direction every time a key lever 8 or the space bar 10 is operated.

A line lock mechanism i.e., the so called right-hand margin lock mechanism for locking the printing clutch mechanism will now be described, which is in its disengaged condition after accomplishment of a printing operation on the last position of a printing line of the paper sheet placed on the platen 4 so as to prevent the next printing operation. As shown in FIG. 2, a margin rack 50 is provided on the carriage 1. A right margin stop 51 is movably supported on the margin rack 50, and selectively positioned in a desired position by engaging with a rack portion of the margin rack 50 so as to define a position corresponding to a desired last printing position of the printing line. A carriage stopper 52 is supported in the machine frame 2 and engageable with the margin stop 51 such that it can be moved a predetermined distance in the leftward and rightward directions. The carriage stopper 52 has its upper side formed with an engagement projection 52*a* for engagement with the margin stop 51 and its lower side formed with a spring mounting leg 52*b*, an operation leg 52*c*, and an engagement pin 52*d*. A weak tension spring 53 is interposed between the spring mounting leg 52*b* and the machine frame 2 to urge the carriage stopper 52 in the rightward direction in FIG. 2.

A stop lever 54 is rotatably mounted on the machine frame 2 for engagement with the engagement pin 52*d* and a strong tension spring 55 is interposed between the stop lever 54 and the machine frame 2 to normally hold the stop lever 54 in engagement with a fixed stopper 56. Thus, the carriage stopper 52 is held in its original position lying substantially midway in its movement range by the combination of the weak tension spring 53 and the stop lever 54. The carriage stopper 52 is adapted to come into engagement with the margin stop 51, which is moved with movement of the carriage 1 in the letter feed direction, when the carriage 1 comes to a position one letter before the last printing position. The carriage stopper 52 is moved one pitch leftward in FIG. 2 from the original position to the first shifting position when the carriage 1 moves to the last printing position, and is further moved one pitch leftward from the first shifting position to a second shifting position when the carriage 1 moves further from the last printing position in the letter feed direction.

A lock member 57 is rotatably mounted on the support shaft 30 in the vicinity of the latch lever 29 and has on its front end a hook portion 57*a* engageable with and disengageable from the holding portion 25*b* of the clutch control lever 25 such that the distance L2 between the stepped portion of the hook portion 57*a* of the lock member 57 and the center of support shaft 30 is shorter than the distance L1 between the stepped portion of the hook portion 29*a* of the latch lever 29 and the center of the support shaft 30 as shown in FIG. 4. A tension spring 58 is provided to urge the lock member 57 toward an operative position where the hook portion 57*a* of the lock member 57 is engageable with the holding portion 25*b* of the clutch control lever 25. An actuating member 59 is disposed between the carriage stopper 52 and the lock member 57 and is rotatably mounted on the machine frame 2 as shown in FIG. 2. The actuating member 59 has a substantially L-shaped lever 60 formed at its one end with a bifurcated portion 60*a* holding therebetween the operating leg 52*c* of the carriage stopper 52, and operation plate 61 pivoted at its rear end to the other end of the L-shaped lever 60 and abutting at its front end on the lock member 57.

Figure 5B:
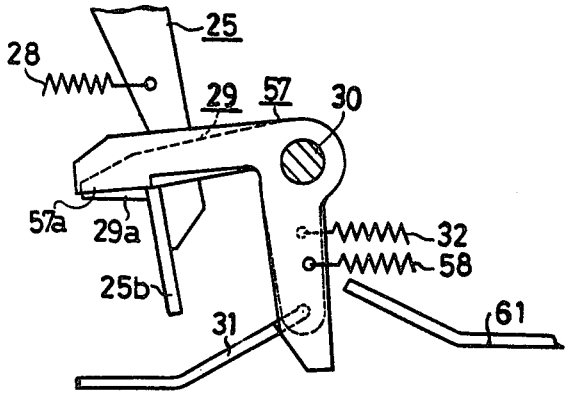
Figure 5C:
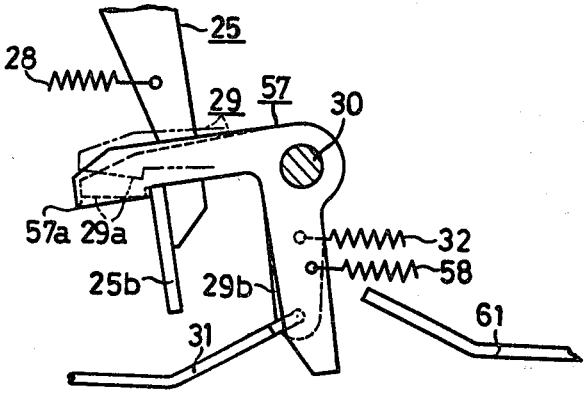

The actuating member 59 is normally held in its original position as shown in FIG. 2 by the forces of the tension springs 53 and 55 acting on the carriage stopper 52 to push the lock member 57 against the force of the tension spring 58 so as to retain the lock member 57 in an inoperative position where the hook portion 57*a* is out of engagement from the holding portion 25*b* of the clutch control lever 25 as shown in FIG. 4. When the margin stop 51 comes into engagement with the carriage stopper 52 supported on the carriage 1 positioned at one letter before the last printing position and pushes the carriage stopper 52 from its original position to the first position with movement of the carriage 1 to the last printing position as described above, the actuating member 59 moves from the original position as shown in FIG. 2 in the arrow direction to an operating position where the lock member 57 is allowed to rotate toward the operative position where its hook portion 57*a* is engageable with the holding portion 25*b* of the clutch control lever 25 by the force of the tension spring 58 as shown in FIG. 5*b*. Thus, at this time, the end surface of the hook portion 57*a* of the lock member 57 is in abutment on the upper edge of the holding portion 25*b* of the clutch control lever 25 positioned in the first position as shown in FIG. 5*b*. When a key lever 8 is depressed to print a letter on the last printing position under this condition, the clutch control lever 25 comes out of engagement from the latch lever 29 and rotates to the second position as shown by the solid line of FIG. 5*a* and then is temporarily returned to the third position beyond the first position as shown by the dotted line of FIG. 5*a* by the function of the return cam 35, the hook portion 57*a* of the lock member 57 comes into engagement of the holding portion 25*b* of the clutch control lever 25 so as to retain the clutch control lever 25 in the third position where the clutch spring 24 is held in its disengaged condition as shown in FIG. 5*c*. Under this condition, a small clearance is formed between the hook portion 29*a* of the latch lever 29 and the holding portion 25*b* of the clutch control lever 25. Thus, even if a key lever 8 is thereafter depressed to push the corresponding interposer 12 down thereby rotating the latch lever 29 in such a direction that the latch lever 29 is released from the clutch control lever 25, the lock member 57 will hold the clutch spring 24 in the disengaged condition so as to prevent the transmission of rotation of the drive shaft 20 to the cam shaft 33, whereby the print head 7 is retained in the original position as shown in FIG. 1 and any printing operation cannot be effected even if the key lever 8 is depressed.

Figure 6:
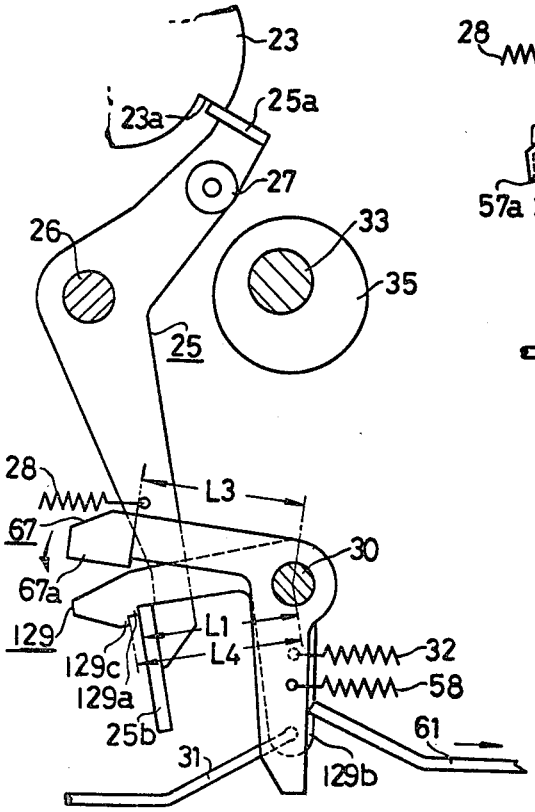
Figure 7A:
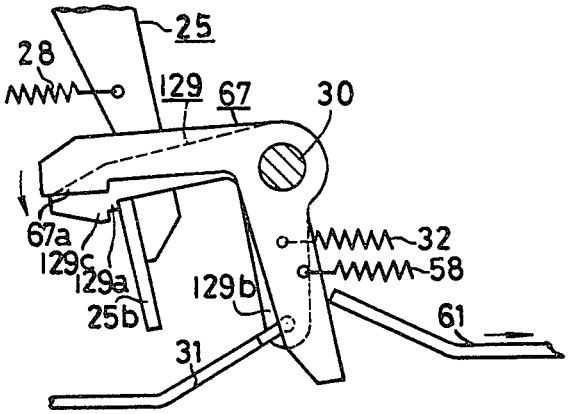
Figure 7B:
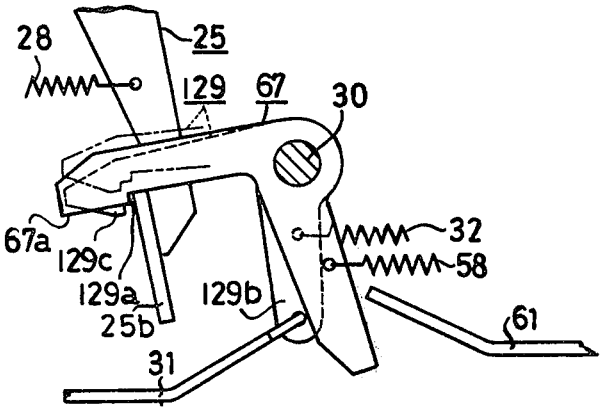
Figure 7C:
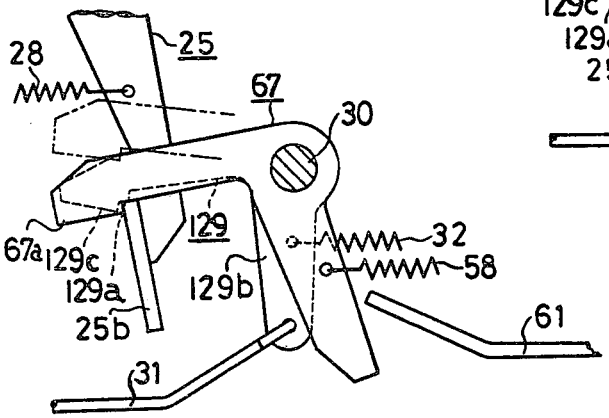
Figure 8:
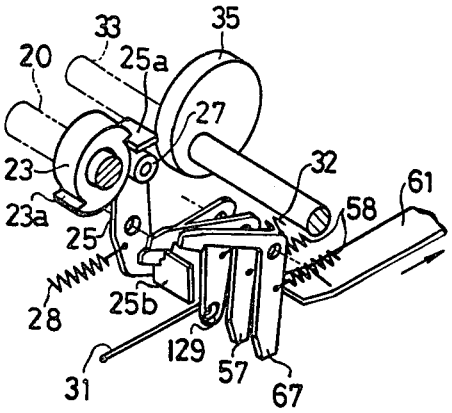

FIGS. 6 to 7*c* illustrate a second embodiment of the present invention which is generally similar to the first described embodiment except for the latch lever and lock member arrangement. Accordingly, the same parts are designated by the same reference numerals as used in connection with the first embodiment and will not be described further. In this embodiment, the latch lever 129 has an additional hook portion 129*c* other than the hook portion 129*a* (hereinafter the former is referred to as a second hook portion 129*c* and the latter as a first hook portion 129*a*). The arm portion 129*b* of this embodiment functions in the same manner as the arm portion 29*b*. The lock member 67 has on its front end a hook portion 67*a* engageable with and disengageable from the holding portion 25*b* of the clutch control lever 25. The relationship of the distance L3 between the stepped portion of the hook portion 67*a* and the center of the support shaft 30 of the lock member 67, the distance L1 between the stepped portion of the first hook portion 129*a* of the latch lever 129 and the center of the support shaft 30 of the latch lever 129, the distance L4 between the stepped portion of the second hook portion 129*c* and the center of the support shaft 30 of the latch lever 129 satisfies a condition of $L4>L3>L1$ as shown in FIG. 6.

The lock member 67 is normally held in its inoperative position as shown in FIG. 6 where the hook portion 67*a* is out of engagement from the holding portion 25*b* of the clutch control lever 25 upon engagement of operation plate 61 of the actuating member 59 with lock member 67. With movement of the carriage 1 in the letter feed direction, the margin stop 51 supported on the carriage 1 comes into engagement with the carriage stopper 52 at one letter before the last printing position, and moves the carriage stopper 52 from the original position to the first position when the carriage 1 moves to the last printing position, whereby the operation plate 61 of the actuating member 59 is retracted. This allows the tension spring 58 to rotate the lock member 67 to a position just before the operative position where the hook portion 67*a* can come into engagement with the holding portion 25*b*, of clutch control lever 25 as shown in FIG. 7*a*. When the carriage 1 moves from the last printing position in the letter feed direction and the carriage stopper 52 further moves from the first position to the second position, the operation plate 61 further retracts so as to allow the tension spring 58 to rotate the lock member 67 to the operative position where the hook portion 67*a* comes into engagement with the clutch control lever 25 as shown in FIG. 7*b*.

Although, in the first embodiment, when the printing operation is accomplished by the printing mechanism at the last printing position, the clutch control lever 25 is locked in the third position by the lock member 57 to hold the clutch spring 24 in the disengaged condition, the second embodiment is constructed such that the lock member 67 can lock the clutch control lever 25 positioned in the vicinity of the first position so as to hold the clutch spring 24 in the disengaged condition with movement of the carriage stopper 52 caused when the carriage 1 moves over the last printing position. Thus, if a key lever 8 or space bar 10 is depressed to drive the escapement mechanism in the case where the carriage 1 is in the last printing position as shown in FIG. 7*a*, the lock member 67 will rotate to the operating position where it can lock the clutch control lever 25 retained in the first position by the first hook portion 29*a* of the latch lever 29 upon the movement of the carriage 1 over the last printing position. Under this condition, a small clearance is formed between the hook portion 67*a* of the lock member 67 and the holding portion 25*b* of the clutch control lever 25 and even if a key lever 8 is thereafter depressed to push the corresponding interposer 12 down thereby rotating the latch lever 29 in such a direction that the latch lever 29 is released from the clutch control lever 25 as shown by the dotted line in FIG. 7*b*, the lock member 67 will lock the clutch control lever 25 after the clutch control lever 25 is slightly rotated from the first position toward the second position by the force of the tension spring 28 so as to hold the clutch spring 24 in the disengaged condition thereby positively preventing any printing operation even if the key lever 8 is depressed. When the key lever 8 is released under this condition and the latch lever 29 placed in the position as shown by the dotted line in FIG. 7*b* is returned by the force of the tension spring 32, the second hook portion 29*c* of the latch lever 29 comes to a position opposite to the holding portion 25*b* of the clutch control lever 25 with a small clearance as shown in FIG. 7*c*. Thus, even if the carriage 1 returns and the operation plate 61 returns to the original position as shown in FIG. 6 thereby rotating the lock member 67 to the inoperative position where the lock member 67 is out of engagement from the holding portion 25*b* of the clutch control lever 25 as shown by the dotted line in FIG. 7*c*, the latch lever 29 will hold the clutch control lever 25 in the vicinity of the first position so as to retain the clutch spring 24 in the disengaged condition thereby preventing the occurrence of mis-printing-operation.

Figure 9:
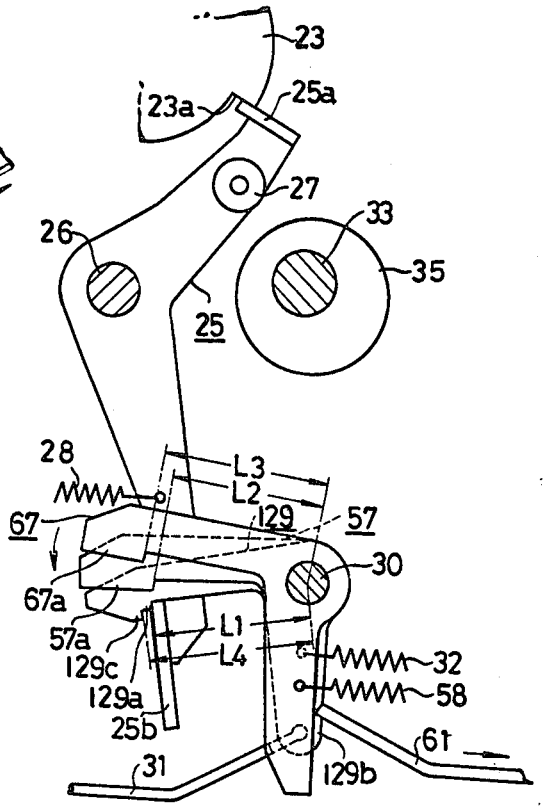

FIGS. 8 to 10*c* illustrate a third embodiment of the present invention which includes a latch lever 29 having two hook portions 129*a*, 129*c* similar to that used in the second embodiment, a lock member 57 similar to that used in the first embodiment, and another lock member 67 similar to that used in the second embodiment (hereinafter the former is referred to as a first lock member 57 and the latter as a second lock member 67). The relationship of the distance L1 between the stepped portion of the first hook portion 29*a* of the latch lever 29 and the center of the support shaft 30 which is the rotary center of the latch lever 29, the distance L4 between the stepped portion of the second hook portion 29*c* of the latch lever 29 and the rotary center of the latch lever 29, the distance L2 between the stepped portion of the hook portion 57*a* of the first lock member 57 and the center of the support shaft 30 which is the rotary center of the first lock member 57, and the distance L3 between the stepped portion of the hook portion 67*a* of the second lock member 67 and the center of the support shaft 30 which is the rotary center of the second lock member 67 satisfies a condition of L4>L3>L1>L2 as shown in FIG. 9.

As shown in FIG. 9, the first and second lock members 57 and 67 are normally held in the inoperative positions where the hook portions 57*a* and 67*a* are out of engagement from the holding portion 25*b* of the clutch control lever 25 by the operation plate 61 of the actuating member 59 abutting on the lock members 57 and 67. With movement of the carriage 1 in the letter feed direction, the margin stop 51 supported on the carriage 1 comes into engagement with the carriage stopper 52 at one letter before the last printing position of the printing line, and moves the carriage stopper 52 from the original position to the first position when the carriage 1 moves to the last printing position, whereby the operation plate 61 is retracted. This allows the first lock member 57 to rotate to a position where it can be lockable with the clutch control lever 25 positioned in the first position or the hook portion 57*a* is in abutment on the upper edge of the holding portion 25*b* of the clutch control lever 25 and also allows the second lock member 67 to rotate to a position just before the position where the second lock member 67 can come into engagement with the holding portion 25*b* of the clutch control lever 25 as shown in FIG. 10*a*.

Figure 10A:
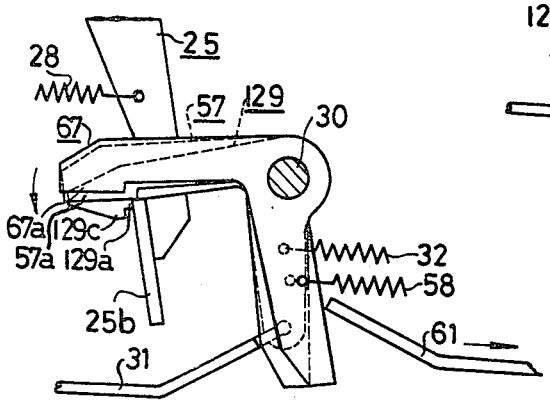
Figure 10B:
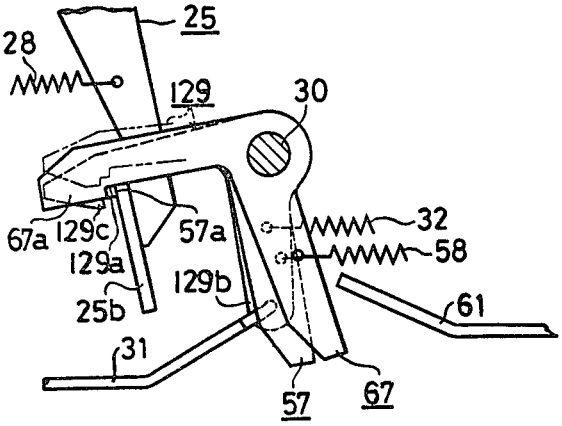

Thus, when a key lever 8 is depressed to effect a printing operation on the last printing position under the condition as shown in FIG. 10*a*, the clutch control lever 25 is released from the latch lever 29 and rotated to the second position where the clutch spring 24 is come into its engaged condition and then temporarily returned to the third position beyond the first position by the function of the return cam 35. The hook portion 57*a* of the lock member 57 comes into engagement with the holding portion 25*b* of the clutch control lever 25 thereby positively locking the clutch control lever 25 in the third position as described in the first embodiment. Since the carriage 1 is moved further from the last printing position in the letter feed direction in synchronism with the printing operation at the last printing position by the escapement mechanism, the carriage stopper 52 is moved from the first position to the second position and thus the operation plate 61 is further retracted from the position as shown in FIG. 10*a*, whereby the second lock member 67 is rotated to a position as shown in FIG. 10*b* where the second lock member 67 can be lockable with the clutch control lever 25 positioned in the vicinity of the first position. Small clearances are formed between the first hook portion 29*a* of the latch lever 29 and the holding portion 25*b* of the clutch control lever 25 and between the hook portion 67*a* of the second lock member 67 and the holding portion 25*b* of the clutch control lever 25. Whereby even if a key lever 8 is thereafter depressed to push the corresponding interposer 12 down thereby rotating the latch lever 29 in such a direction that the latch lever 129 is released from the clutch control lever 25 as shown by the dotted line in FIG. 10*b*, the first lock member 57 already locks the clutch control lever 25 in the third portion so as to hold the clutch spring 24 in the disengaged condition, thereby positively preventing any printing operation.

Figure 10C:
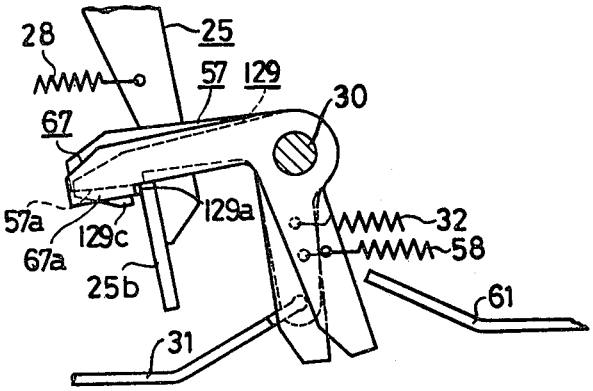

On the other hand, when the space bar 10 is depressed to drive only the escapement mechanism in case where the carriage 1 is in the last printing position as shown in FIG. 10*a*, the escapement mechanism moves the carriage 1 from the last printing position in the letter feed direction without any printing operation. The carriage stopper 52 is moved from the first position to the second position and the operation plate 61 is further retracted from the position as shown in FIG. 10*a*. Thus, the hook portion 57*a* of the first lock member 57 is held in abutment on the upper edge of the holding portion 25*b* of the clutch control lever 25 as shown in FIG. 10*c*, whereas the second lock member 67 is rotated to the operative position where it is lockable with the clutch control lever 25 positioned in the first position with retracting movement of the operation plate 61.

Under this condition, a small clearance is formed between the hook portion 67*a* of the second lock member 67 and the holding portion 25*b* of the clutch control lever 25, and even if a key lever 8 is thereafter depressed to push the corresponding interposer 12 down thereby rotating the latch lever 29, the clutch control lever 25 will be locked by the second lock member 67 after it rotates slightly from the first position toward the second position, whereby the clutch spring 24 is held in the disengaged condition and the printing operation can be positively prevented even if the key lever 8 is depressed as described in connection with the second embodiment. If the key lever 8 is released and the latch lever 29 returns to the original position, the latch lever 29 will be positioned in the position where the second hook portion 29*c* of the latch lever 29 can lock the clutch control lever 25 and even if the carriage 1 returns thereafter so as to rotate the second lock member 67 in such a direction that the second lock member 67 is released from the clutch control lever 25, the clutch control lever 25 will be locked in the vicinity of the first position by the second hook portion 29*c*, whereby the clutch spring 24 is held in the disengaged condition.

Figure 11:
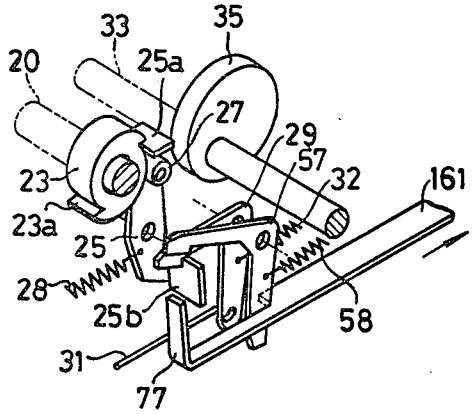

FIGS. 11 to 13*c* show a fourth embodiment of the present invention which includes a latch lever 29 similar to that used in the first embodiment, a lock member 57 similar to that used in the first embodiment, and an additional lock member 77 (hereinafter the former is referred to as a first lock member 57 and the latter as a second lock member 77). As shown in FIG. 11, the operation plate 61 of the actuating member 59 has at the other end a portion turned upward to form the second lock member 77 which is positioned to a position where it can come into engagement with the holding portion 25*b* of the clutch control lever 25 positioned in the first position so as to lock the clutch control lever 25 when the carriage 1 moves over the last printing position and the carriage stopper 52 moves from the first position to the second position to thereby retract the operation plate 61.

Figure 12:
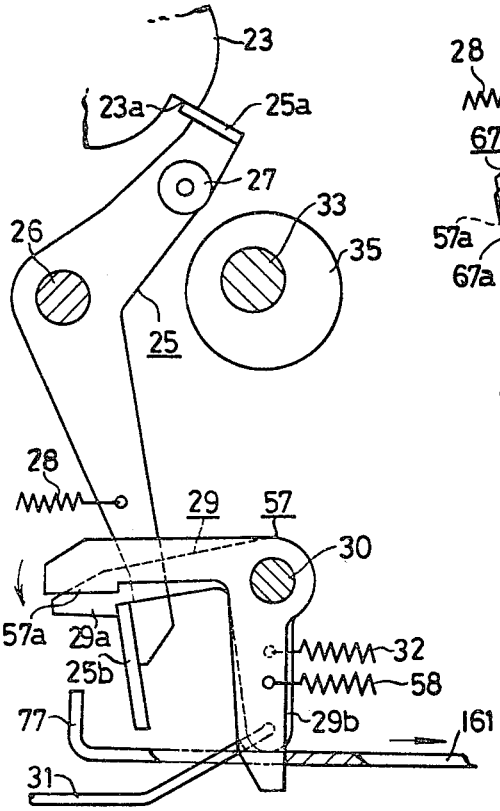
Figure 13A:
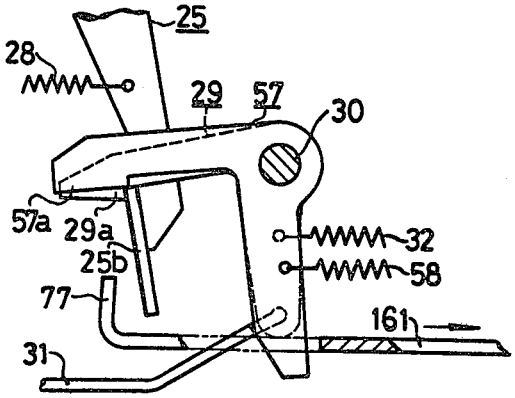
Figure 13B:
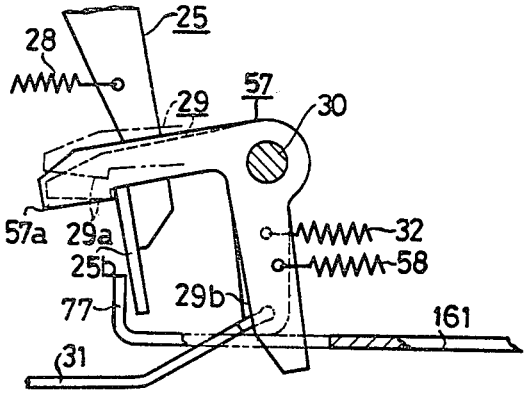
Figure 13C:
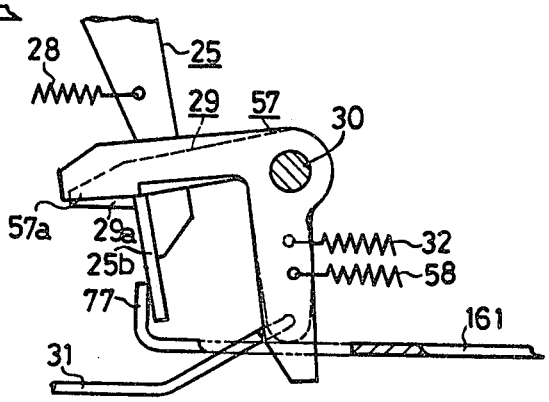

Thus, the first and second lock members 57 and 77 are normally held in the inoperative positions respectively as shown in FIG. 12 where they are out of engagement from the clutch control lever 25 in the same manner as described in connection with the third embodiment. When the carriage 1 moves to the last printing position and the carriage stopper 52 moves from the original position to the first position, the first lock member 57 is rotated to the position where it can come in engagement with the clutch control lever 25 positioned in the first position, as shown in FIG. 13*a*. When a key lever 8 is thereafter depressed to effect a printing operation on the last printing position and the clutch control lever 25 is temporarily returned to the third position by the function of the return cam 35, the clutch control lever 25 is locked by the first lock member 57 as shown in FIG. 13*b*. When the space bar 10 is depressed under a condition as shown in FIG. 13*a* to move the carriage 1 from the last printing position in the letter feed direction thereby moving the carriage stopper 52 from the first position to the second position, the second lock member 77 is moved to the operating position as shown in FIG. 13*c* where the second lock member 77 comes in engagement with the holding portion 25*b* of the clutch control lever 25 so as to lock the clutch control lever 25 in the first position, whereby the printing operation is prevented even if the key lever 8 is depressed.

It is to be observed therefore that there has been provided in accordance with the present invention a typewriter comprising a printing mechanism driven every time a key lever is depressed, an escapement mechanism driven in synchronism with the operation of the printing mechanism for intermittently moving the carriage in the letter feed direction, a printing clutch interposed between a drive motor and the printing mechanism, a control lever for engaging the printing clutch when a key lever is depressed to print a letter on the last printing position or when a space bar is depressed to move the carriage from the last printing position in the letter feed direction, and a lock member for locking the control lever so as to hold the printing clutch in its disengaged condition, which can positively prevent any printing operation even if a key lever is depressed after the carriage moves over the last printing position which is defined by the right-hand margin stop.

We claim:

1. In a power operated typewriter having a frame, a driving motor, a keyboard, a printing mechanism operated upon depression of each key of the keyboard, an escapement mechanism actuated upon operation of the printing mechanism, a carriage which is moved step by step in a letter feed direction by the escapement mechanism;

a right-hand margin line lock mechanism, comprising in combination:

(a) a clutch (23) disposed between the motor and the printing mechanism;

(b) a control lever (25) normally held in a first position for keeping said clutch (23) in a disengaged condition;

(c) control means for moving said control lever from the first position to a second position allowing said clutch to come into an engaged condition in order to operate said printing mechanism upon depression of each key;

(d) a cam member (35) rotated upon engagement of said clutch for temporarily bringing said control lever from the second position to a third position passing over the first position for allowing said printing mechanism to come into a disengaged condition;

(e) first and second stoppers (51, 52) for defining a last printing position of a printing line, said first stopper supported by the carriage and said second stopper movably supported by said frame and normally held in an original position engaging with said first stopper when said carriage has been moved to a position one letter before the last printing position, and said second stopper being moved a predetermined distance from the original position when said carriage has been moved to the last printing position;

(f) a lock member (57) movably supported by the frame so as to move between an inoperative position and an operative position, said lock member (57) normally held in the inoperative position, and being lockable with said control lever in the third position so as to hold said clutch in the disengaged condition when said lock member moves to the operative position; and, (g) an actuating member (59) normally held in an original position and actuated by the second stopper so as to move said lock member to the operative position when said second stopper moves the predetermined distance, whereby, said lock member in the operative position locks said control lever when said control lever has been brought to the third position by said cam member upon the printing operation of said printing mechanism at the last printing position.

2. In power operated typewriter claimed in claim 1 wherein said control means comprises a spring for biasing said control lever toward the second position, a latch lever normally held in a latching position for latching said control lever positioned in the first position against a biasing force of said spring, and transmitting means for transmitting the depressing movement of the each key to said latch lever to move said latch lever from the latching position to an unlatching position.

3. In a power operated typewriter claimed in claim 2 wherein, said lock member is interrupted in the movement to the operative position by an edge of said control lever positioned in the first position, and then locks said control lever in the third position by said cam member when the printing operation of said printing mechanism has been accomplished at the last printing position.

4. In a power operated typewriter having a driving motor, a keyboard, a printing mechanism operated upon depression of each key of the keyboard, an escapement mechanism actuated upon operation of the printing mechanism and depression of a space bar, a carriage moved step by step in a letter feed directed by the escapement mechanism, and a right-hand margin line lock mechanism, the right-hand margin line lock mechanism comprising;

a clutch disposed between the motor and the printing mechanism;

a control lever normally held in a first position for keeping said clutch in a disengaged condition;

control means for moving said control lever from the first position to a second position allowing said clutch to come into an engaged condition in order to operate the printing mechanism upon depression of the each key;

a cam member rotated upon engagement of said clutch for temporarily bringing said control lever from the second position to a third position passing over the first position for allowing said printing mechanism to come into a disengaged condition;

first and second stoppers for cooperatively defining a last printing position of a printing line, said first stopper supported by the carriage and said second stopper movably supported by a frame of the typewriter and normally held in an original position engaging with said first stopper when said carriage has been moved to a position one letter before the last printing position, and said second stopper moved from the original position to a first shifting position when said carriage has been moved to the last printing position, and then from the first shifting position to a second shifting position when said carriage has been moved from the last printing position in the letter feed direction;

first and second lock members movably supported respectively by the frame so as to move between an inoperative position and an operative position, said first and second lock members normally held in the inoperative position, and lockable with said control lever in either position of the first and third positions so as to hold said clutch in the disengaged condition when said first and second lock members move to the operative position; and actuating means normally held in an original position and actuated upon movement of said second stopper so as to move said first lock member to the operative position when said second stopper moves to the first shifting position, and to move said second lock member to the operative position when said second stopper moves to the second shifting position; whereby said first lock member held in the operative position locks said control lever when said control lever has been brought to the third position by said cam member upon printing operation of said printing mechanism at the last printing position, and said second lock member moved to the operative position locks said control lever in the first position for preventing said printing mechanism from operating upon depression of each key after the carriage is moved from the last printing position of the printing line in the letter feed direction.

5. In a power operated typewriter claimed in claim 4 wherein, said control means comprises;

a spring for biasing said control lever toward the second position;

a latch lever having a hook portion pivotally supported by a shaft, and normally held in a latching position for latching said control lever positioned in the first position against a biasing force of said spring; and transmitting means for transmitting the depressing movement of the each key to said latch lever in order to move said latch lever from the latching position to an unlatching position.

6. In a power operated typewriter claimed in claim 5 wherein, said actuating means comprises an L-shaped lever having one end portion engaging with said second stopper, and an operation plate having one end portion connected with the other end portion of said L-shaped lever.

7. In a power operated typewriter claimed in claim 6 wherein, said a and second lock members respectively having hook portions lockable with said control lever and edge portions engageable with the other end of said operation plate.

8. In a power operated typewriter claimed in claim 10 wherein said first and second lock members are pivotally supported by a shaft, which supports said latch lever pivotally, said lock members are biased toward each operative position by a spring, and each lock member is normally held in said inoperative position by engagement of the edge portion thereof with the other end of the operation plate positioned in the original position.

9. In a power operated typewriter claimed in claim 8 wherein, a distance L1 between a center of the shaft and said hook portion of said latch lever is longer than a distance L2 between a center of the shaft and said hook portion of said first lock member, and shorter than a distance L3 between a center of the shaft and said hook portion of said second lock member.

* * * * *